US009476675B1

(12) United States Patent
Manglos

(10) Patent No.: US 9,476,675 B1
(45) Date of Patent: Oct. 25, 2016

(54) POUCH FOR CONCEALED HANDGUN WITH MAGNETIC CLOSURE

(71) Applicant: David Manglos, Stafford, VA (US)

(72) Inventor: David Manglos, Stafford, VA (US)

( * ) Notice: Subject to any disclaimer, the term of this patent is extended or adjusted under 35 U.S.C. 154(b) by 0 days.

(21) Appl. No.: 14/999,487

(22) Filed: May 13, 2016

(51) Int. Cl.
*F41C 33/02* (2006.01)
*F41C 33/04* (2006.01)
*F42B 39/02* (2006.01)

(52) U.S. Cl.
CPC ..... *F41C 33/0218* (2013.01); *F41C 33/041* (2013.01); *F41C 33/048* (2013.01); *F42B 39/02* (2013.01); *A45F 2200/0591* (2013.01); *F41C 33/0209* (2013.01); *Y10S 224/911* (2013.01)

(58) Field of Classification Search
CPC F41C 33/02; F41C 33/0209; F41C 33/0218; F41C 33/048; A45F 2200/0591; Y10S 224/911
USPC ..... 224/239
See application file for complete search history.

(56) References Cited

U.S. PATENT DOCUMENTS 2,413,580 A * 12/1946 Perry ..... F42B 39/02 206/3
3,008,617 A * 11/1961 Villwock ..... F41C 33/0209 224/183
3,347,299 A * 10/1967 Alexander ..... A45C 3/06 150/106
3,630,420 A * 12/1971 Bianchi ..... F41C 33/0209 224/193
4,190,183 A * 2/1980 Yates ..... F41C 33/0218 224/235
4,898,310 A * 2/1990 Remington ..... F41C 33/0218 224/198
5,170,919 A * 12/1992 DeSantis ..... A45C 1/04 224/192
5,234,145 A * 8/1993 Padin ..... F41C 33/0218 224/192
5,374,919 A * 12/1994 Zelka ..... G08B 15/004 224/196
5,495,967 A * 3/1996 Parton ..... A45C 3/06 190/106
5,505,355 A * 4/1996 Williams ..... A45C 1/04 224/243
5,909,834 A * 6/1999 Parrott, III ..... F41C 33/0209 224/245
5,924,565 A * 7/1999 Colee ..... F41C 33/0218 206/317
5,967,393 A * 10/1999 Clarke, III ..... F41C 33/0218 206/317
6,076,715 A * 6/2000 Easter ..... F41A 23/18 224/149

(Continued)

FOREIGN PATENT DOCUMENTS

CA 2497357 A1 * 10/2005

*Primary Examiner* — Justin Larson
(74) *Attorney, Agent, or Firm* — Thomas J. Wallen, P.E., Attorney at Law LLC

(57) ABSTRACT

A pouch for a handgun adapted to be worn on the belt of a user, the bag including a releasably closable ammunition compartment located within and on the bottom of the bag for accessing extra ammunition wherein the compartment is closed with a flap secured to the bag and releasable from the bag by micro hook and loop fasteners, and wherein the compartment is oriented such that upon separating the flap from the bag the contents of the compartment drop into the hand of the user by gravity. A magnetic closure releasably seals the pouch, whereby the user can open the pouch and reach into the pouch to access a handgun without the possibility of a stuck zipper.

14 Claims, 9 Drawing Sheets

(56) References Cited

U.S. PATENT DOCUMENTS 6,131,198 A * 10/2000 Westrick ..... F41C 33/0209 2/102
6,161,738 A * 12/2000 Norris ..... A45C 9/00 109/49.5
6,253,915 B1 * 7/2001 Mesica ..... F41C 33/06 206/317
7,065,841 B2 * 6/2006 Sjoquist ..... A41F 1/002 24/303
8,006,604 B2 * 8/2011 Camp ..... F41C 33/06 206/317
8,328,058 B2 * 12/2012 Wilson ..... A45F 3/005 224/243
8,622,269 B2 * 1/2014 Hogue ..... F41C 33/0218 224/587
9,009,870 B1 * 4/2015 Connick, Jr. ..... A41D 27/20 2/252
9,265,319 B1 * 2/2016 Zeh-Franke ..... A45C 13/02
2004/0217141 A1 * 11/2004 Brooks ..... A45F 5/021 224/587
2005/0241208 A1 * 11/2005 Ditchfield ..... F41J 13/00 42/106
2007/0000965 A1 * 1/2007 Cannon ..... F41C 33/06 224/673
2007/0145091 A1 * 6/2007 Meesey ..... A45F 3/08 224/649
2009/0320184 A1 * 12/2009 Schaefer ..... A41B 9/02 2/405
2016/0084614 A1 * 3/2016 Ellingson ..... A45C 11/24 224/243
2016/0123700 A1 * 5/2016 Manglos ..... F42B 39/02 150/112
2016/0186789 A1 * 6/2016 Nelson ..... F16B 1/00 24/303

* cited by examiner

POUCH FOR CONCEALED HANDGUN WITH MAGNETIC CLOSURE

CROSS REFERENCE TO RELATED APPLICATIONS

This application is a Continuation in-Part of U.S. Utility application Ser. No. 14/121,877, filed Oct. 31, 2014, the benefit of the filing date claimed pursuant to 35 U.S.C. §120, which disclosure is fully incorporated herein.

STATEMENT REGARDING FEDERALLY SPONSORED RESEARCH OR DEVELOPMENT

No federally sponsored research or development is disclosed or claimed herein.

THE NAMES OF PARTIES TO A JOINT RESEARCH AGREEMENT

This application, is not the subject of any joint research agreement.

INCORPORATION-BY-REFERENCE OF MATERIAL SUBMITTED ON A COMPACT DISK

Not Applicable

BACKGROUND OF THE INVENTION

A number of holsters have been designed to carry firearms, attached to the body by means of a belt, or carried loosely. These holsters are generally provided with a leather strap or other means closing over the handle of the weapon by means of a clasp, button, or the like. Some manner of clothing is usually necessary to conceal the presence of the firearm.

U.S. Pat. No. 4,190,183 issued to Yates relates to a hand gun case to store a hand gun. More specifically the hand gun case comprises a main body and closure flap. The main body comprises a forward and rear panel. The closure flap, movable between an open and closed position, extends outwardly from the rear panel adjacent the opening formed between the forward and rear panels to enclose the pistol within the hand gun case when in the closed position. The closure flap is configured similarly to the main body. In this configuration, the outline of the closure flap overlies or registers with the outline of the main body when the handgun case is closed.

The handgun case further includes a first closure element comprising a first and second member formed on the forward panel and closure flap respectively. The first and second members may comprise a Velcro® or hook and loop type fasteners. A secondary flap is disposed below the first member such that is may be tucked under the second closure element. The second closure element comprises a strap extending across the front panel The diagonal strap is located adjacent to and below the first closure element on the forward panel and at the same time permits hand room for insertion between the front panel and closure flap when the closure flap is in the closed position. U.S. Pat. No. 5,170,919 issued to DeSantis et al. discloses a handgun in a holster which is completely concealed by a simulated carrying pouch. A backing is mounted on a wearer, as with a belt around the wearer's waist. A holster is mounted on the backing completely within the area defined by the top, bottom and ends of the backing. A flap, permanently attached at the bottom to the backing but releasably attached by hook and pile fasteners (Velcro®) at the top and two ends of the backing defines a textile material (fabric) or leather container which simulates a carrying pouch and conceals the holster and hand gun. Pockets may be provided in the flap. The holster is reversibly mounted on the backing using hook and pile fasteners, and hook and pile fastener straps releasably hold the hand gun within the holster. To gain access to the hand gun, the hook and pile fasteners at the top and two ends of the backing and flap are detached to completely expose the handgun for access.

None of the prior art pouches for concealing handguns offer ready and quick access to extra ammunition in an emergency situation. Also the prior art pouches do not securely store the handgun such that it cannot disengage from the holster accidently. An inherent flaw in the pouch of DeSantis et al., a flaw shared by the Yates pouch, is the Velcro® fastening system, which quickly loses its effectiveness as the hooks and loops trap dirt and simply wear out from use, allowing a firearm to potentially drop to the ground and accidentally discharge.

BRIEF SUMMARY OF THE INVENTION

A pouch that resembles a conventional bag is adapted to be worn on the belt of the user. The pouch is specifically designed to securely hold a handgun in a position where it can be readily accessed in an emergency situation. To the onlooker the pouch is indistinguishable from common bags that are worn on the belt. The bag offers quick and convenient access to extra ammunition, including extra magazines for a semi-automatic handgun or a speed-strip or other speed loading apparatus for a revolver.

The bag is constructed as a rectangular parallelepiped with two opposing parallel faces, a rear face that contacts the wearer, and a front face that faces away from the wearer. A zipper joins the two faces, the zipper extending across the top of the pouch and down one side of the pouch. The panels are joined across the bottom of the pouch and up the second side by stitching or otherwise. The pouch includes three separate compartments as further described herein.

A compartment facing downwardly, on the bottom of the pouch, has a Velcro® flap that opens and enables an extra magazine with cartridges or a rapid loading apparatus for a revolver to drop directly into the hand of the user.

Various compartments located within the pouch are specifically adapted for items including storage of speed loading strips, speed loaders for revolvers, law enforcement badges, and concealed carry permits.

The pouch for a handgun is adapted to be worn on the belt of a user. The bag includes a releasably closable ammunition compartment located within and on the bottom of the bag for accessing extra ammunition wherein the compartment is closed with a flap secured to the bag and releasable from the bag by micro hook and loop fasteners. The compartment is oriented such that upon separating the flap from the bag the contents of the compartment drop into the hand of the user by gravity. The pouch is constructed with one front face panel and a parallel rear face panel, with at least one vertical side panel permanently affixed to the front and rear panels, and at least one horizontal side panel permanently affixed to the front and rear panels, the vertical and horizontal side panels interposed between the front face panel and the rear face panel forming two perimeter sides of the bag interposed between the front and rear face panels. A first horizontal side flap and a first vertical side flap are located parallel to the side panels affixed to the front and rear panels, and on opposite sides of the bag from the side panels. The horizontal side flap overlies a magnetic closure releasably sealing the horizontal side flap, and the vertical side flap overlies a magnetic closure releasably sealing the vertical side flap, such that the horizontal side flap and the vertical side flap can be releasably closed and opened around the top and rear of the pouch, whereby the user can open the pouch and reach into the pouch to access a handgun.

BRIEF DESCRIPTION OF THE SEVERAL FIGURES OF THE DRAWINGS

DETAILED DESCRIPTION OF THE VARIOUS FIGURES OF THE INVENTION

Figure 1:
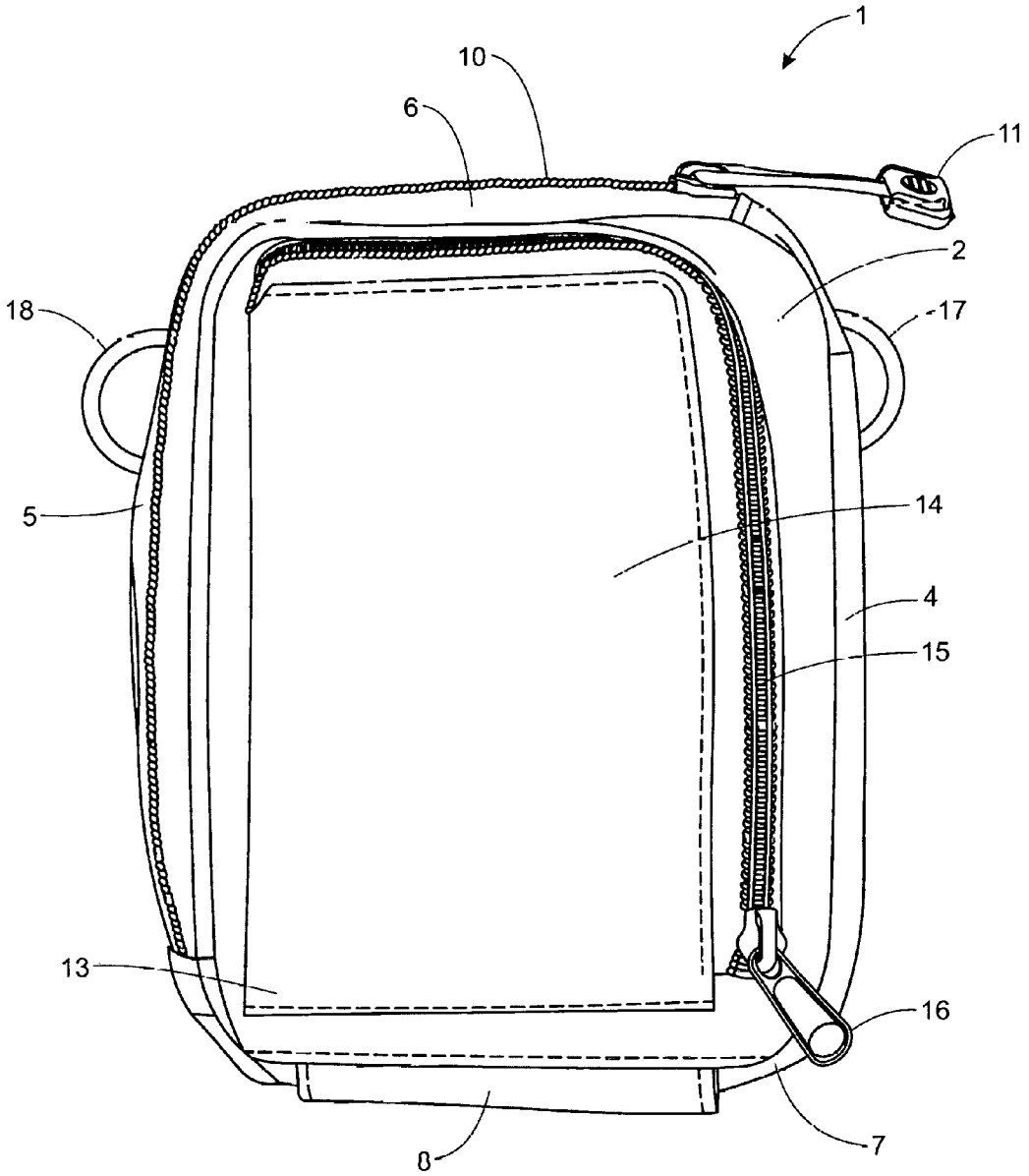
FIG. 1 shows the front of the bag according to the invention as the bag would appear when worn on a users belt

Referring to FIG. 1, bag (1) according to the instant invention is seen as an onlooker would see the bag (1) when it is attached to a user's belt. The bag is constructed of two face panels, front face (2) and rear face (3) (best seen in FIG. 2), and four side panels, forward vertical side panel (4), rearward vertical side panel (5), top horizontal side panel (6) and bottom horizontal side panel (7). The four side panels form the perimeter or sides of the bag; while the front and rear panels form two parallel planes, the front and rear faces of the bag. It is understood that bag (1) as seen in the figures is for a right-handed user.

The front face (2) of bag (1) is semi-detachable from the rear face (3) by zipper (10). When worn, if the user desires to access the firearm, the user merely pulls zipper tab (11). Top, horizontal side panel (6) and rearward, vertical side panel (5) are substantially bisected by zipper (10), or 180 degrees around the bag. When zipper (10) is fully disengaged the user can readily place his hand into the firearm compartment (12) (best seen in FIGS. 3 and 5), and withdraw his firearm, as the top and rear of the bag are open and face the user's hand. The firearm cannot be jostled and fall forward because the front side panel remains closed; nor can the firearm drop accidentally because the bottom side panel also remains closed.

Figure 4:
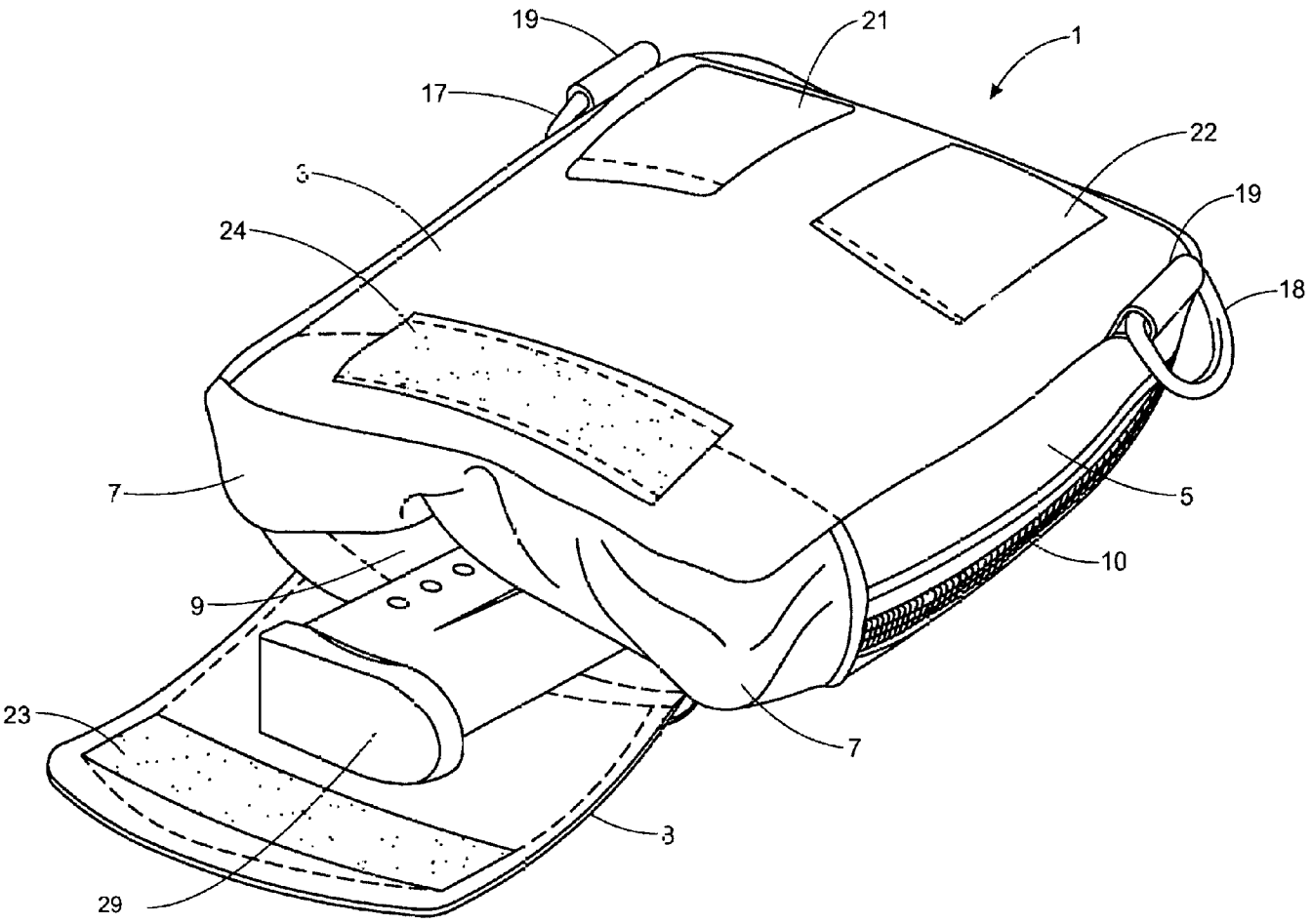
FIG. 4 shows the rear face of the bag with the magazine compartment in an open state and with a magazine for a semi-automatic handgun extending from the ammunition compartment.
Figure 5:
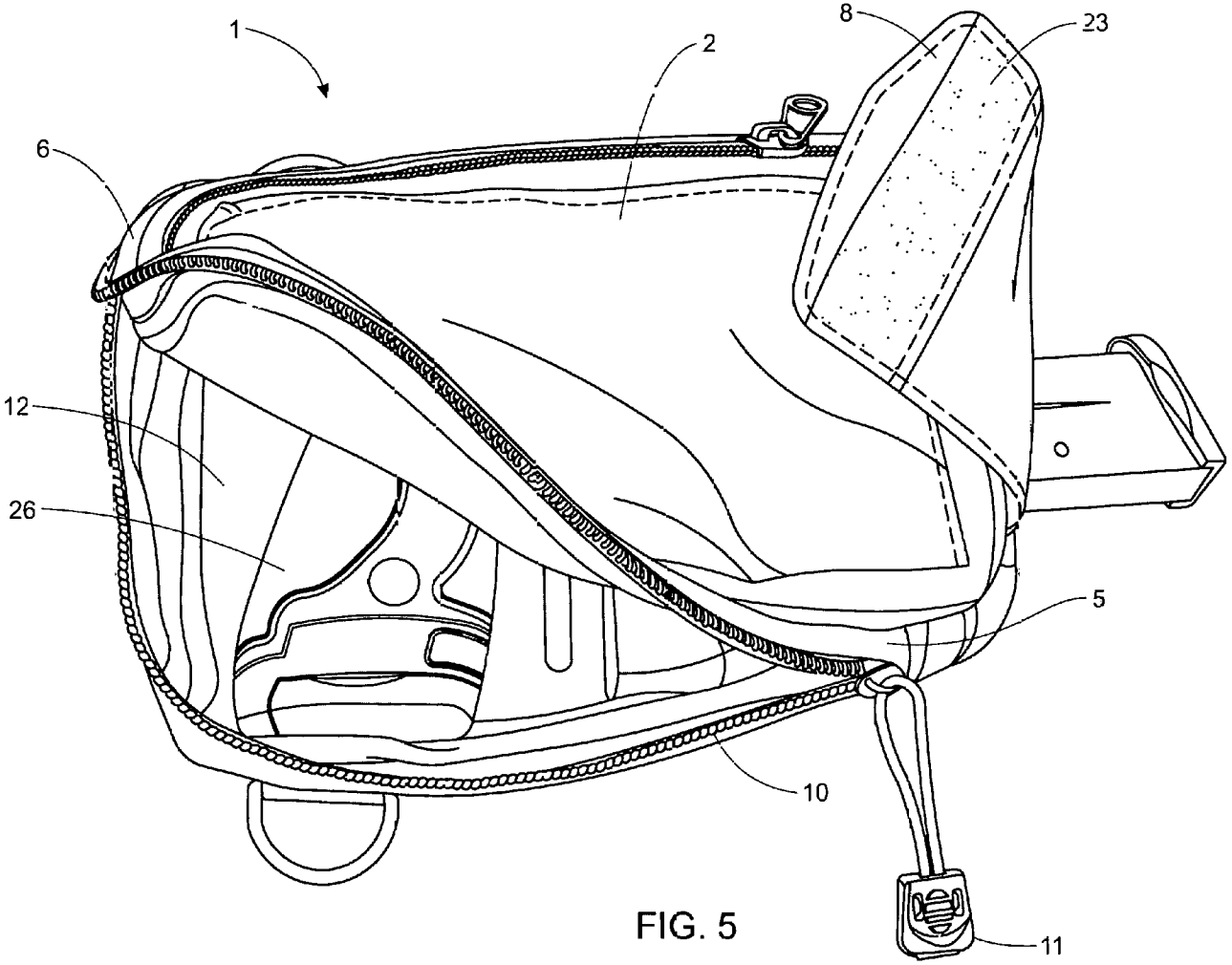
FIG. 5 shows the front face of the bag in a fully open state with a semi-automatic handgun located in the firearm compartment. A magazine for a semi-automatic handgun is protruding from a separate ammunition compartment.

Referring again to FIG. 1, lower flap (8) exposes ammunition compartment (9) (best seen in FIG. 4 or 5). When flap (8) is opened, an extra magazine for a semi-automatic firearm or a rapid loading apparatus for a revolver quickly drops by gravity into the user's hands.

It must be emphasized that the entire operation of opening the firearm compartment (12), withdrawing the firearm, opening the ammunition compartment, and withdrawing ammunition are all accomplished with only a single hand, leaving the users other hand completely free to handle a flashlight, etc.

The front face (14) of outer compartment (13) partially overlies front face (2). A second zipper (15) extends vertically from the bottom side panel, parallel to the front side panel, and across and parallel to the top side panel, or 180 degrees around the bag. When the zipper is disengaged, by pulling zipper tab (16), the user is free to access equipment within compartment (13). D rings (17) and (18) attach to the rear face of the bag. The D rings are for attaching nylon or other material adjustable web belt for use with running shorts or hiking pants without belt loops. Plastic clips on each end of the belt would removably attach to the D rings. The belt length will be adjustable with a typical plastic slide. The belt would also allow the pouch to be slung across the shoulder, hanging under the opposing arm. The pouch would hang at the wear's side under the arm. This way the pouch can be concealed under a jacket or worn slung openly, not concealed.

Figure 2:
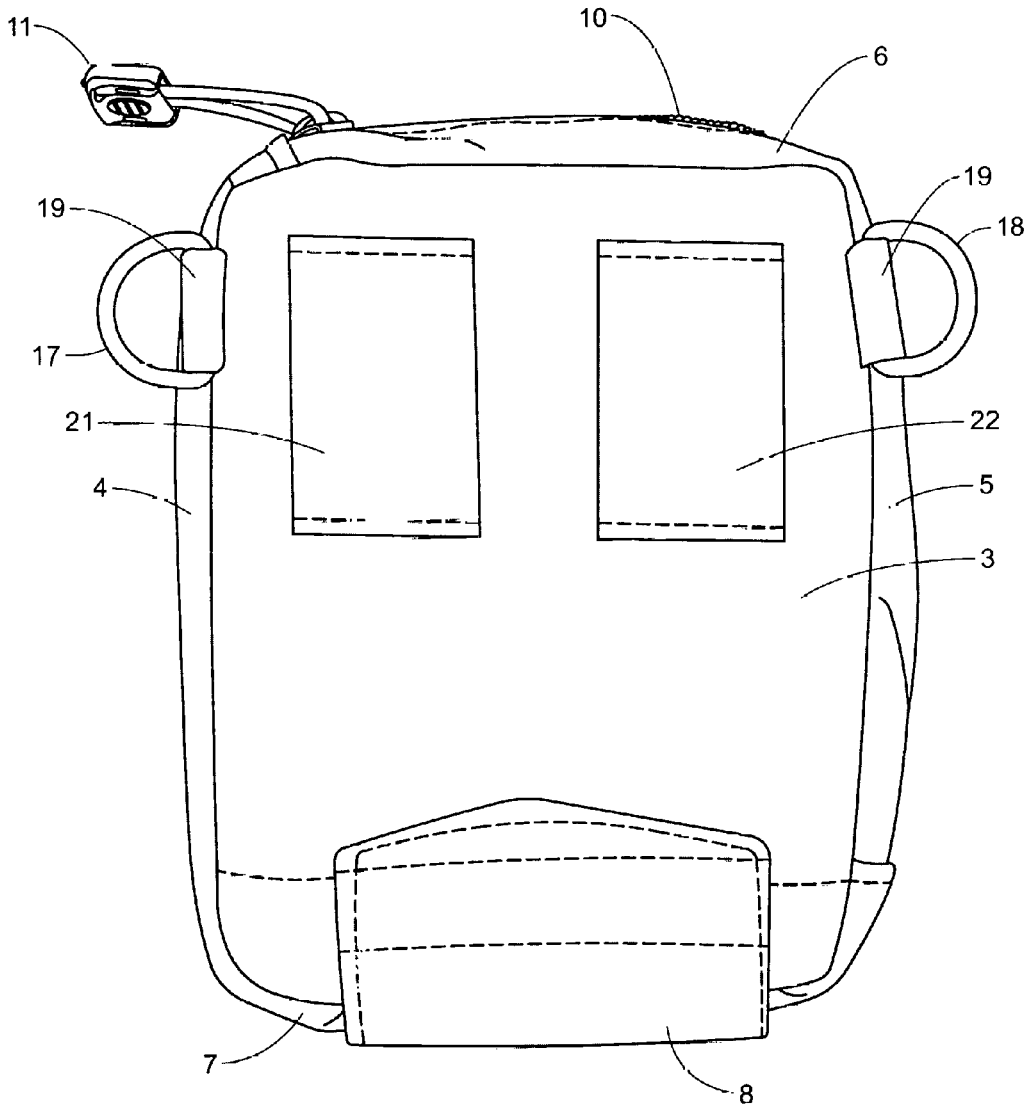
FIG. 2 shows the rear of the bag which rear side faces the user and rests against the user when it is attached to the user's belt.

FIG. 2 shows the rear face (3) of the bag according to the invention. The rear of the bag is attached to the users belt with belt loops (21) and (22), which are stitched or otherwise attached to the rear face (3) of the bag. D rings (17) and (18) attach to the top of rear face (3) using stitched webbing (19) in the conventional manner. Webbing (19) overlies the un-curved part of the D rings and the ends of webbing (19) is integrally stitched into the intersection of rear face (3) and the two vertical side panels (4) and (5). Flap (8) is shown in closed position, securely closing ammunition compartment (9) (seen open in FIGS. 4 and 5). Flap (8) is stitched to or integrally formed with the bottom of front panel (2), and extends transversely across the bottom side panel. Because the flap (8) is releasably closed from the rear face (3), the presence of the ammunition compartment is virtually entirely concealed from the onlooker. Flap (8) is conveniently the width of an err magazine for a semi-automatic pistol, or the size of a rapid loading apparatus for a revolver. Therefore, flap (8) need not extend across the entire bottom of bag (1), but advantageously is sized to allow a magazine or other loading mechanism to drop into the palm of the user's hand. Flap (8) removably attaches to the rear face (3) of bag (1) in any conventional manner, but hook and loop fasteners (23) and (24) (best seen in FIGS. 4, 5), known as Velcro®, is the preferred fastener.

Figure 3:
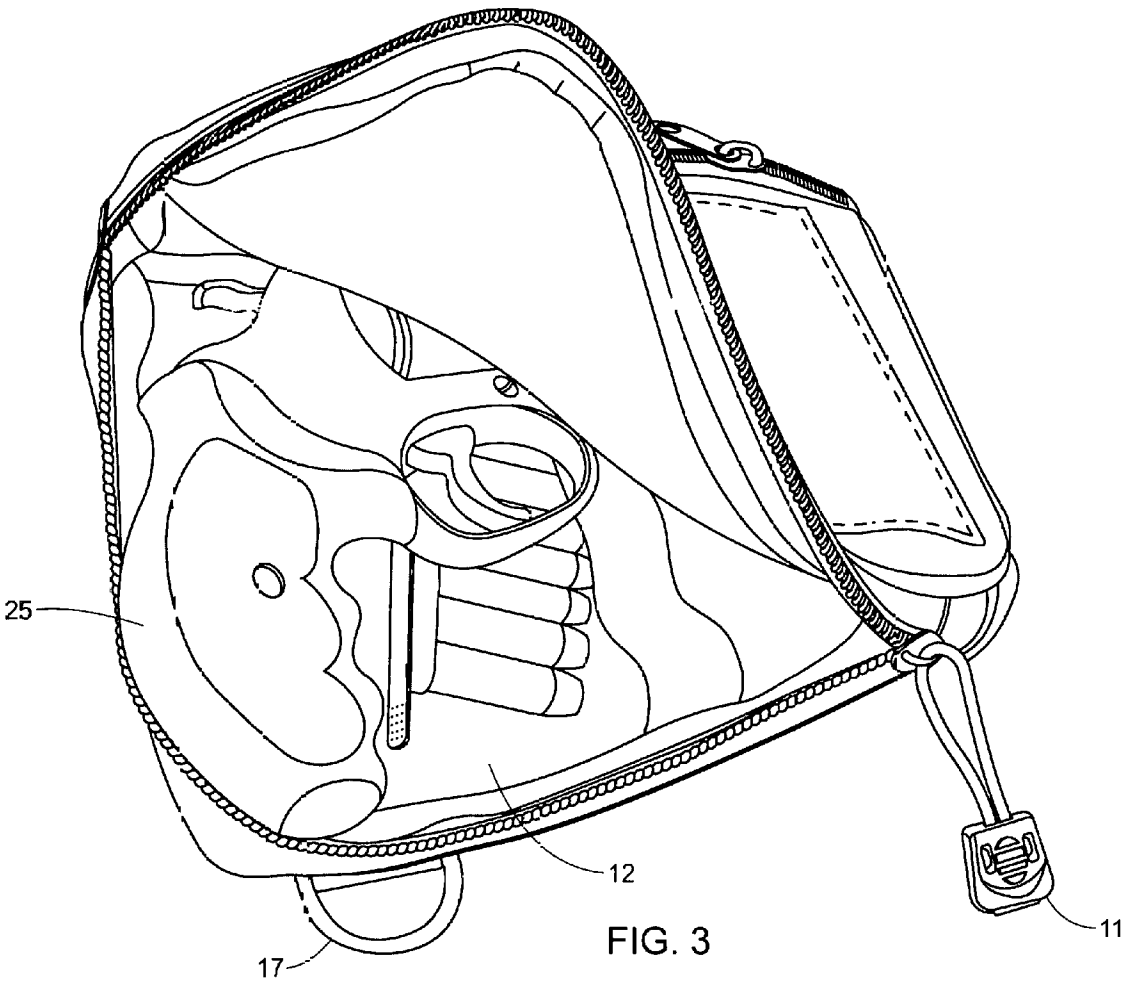
FIG. 3 shows the front face of the bag in a fully open state, revealing a firearm compartment. A revolver and ammunition is located inside the hag in the firearm compartment.

FIG. 3 shows bag (1) as it appears with zipper (10) fully disengaged by pulling zipper tab (11). Front face (2) can be folded back across the diagonal of front face (2). The user can readily reach into firearm compartment (12) of the bag and quickly withdraw a firearm, in this case revolver (25).

FIG. 4 shows the rear face (3) of bag (1), with flap (8) in an open position allowing a magazine (29) for a semi-automatic weapon to drop out of the ammunition compartment (9). Firearm compartment (12) is closed in FIG. 5. Velcro® fastener panel (24) is seen stitched onto the rear face (3) of bag (1). When Velcro® panel (23) disengages from Velcro® panel (24), as shown, magazine (29) readily drops into the user's hand.

FIG. 5 shows bag (1) as it appears with zipper (10) fully disengaged by pulling zipper tab (11). Front face (2) can be folded back across the diagonal of front face (2). The user can readily reach into firearm compartment (12) the bag and quickly withdraw a firearm, in this case semi-automatic pistol (26). Flap (8) has been disengaged, and ammunition compartment (9) is accessible. As previously discussed, when bag (1) is attached to a user's belt, the ammunition, in this case a magazine for an automatic pistol, drops by gravity into the user's hand. Velcro® panel (23) is seen stitched onto the side of flap (8) that faces rear face (3).

Zipper (10) extends only partially across top side panel (6) and only partially down vertical side panel (5). By limiting the travel of zipper (10) the incidence of a stuck zipper is reduced. Of course, no fabric tags or other ends after stitching are allowed to extend into the zipper area, to prevent fabric from jamming the zipper (10).

Figure 6:
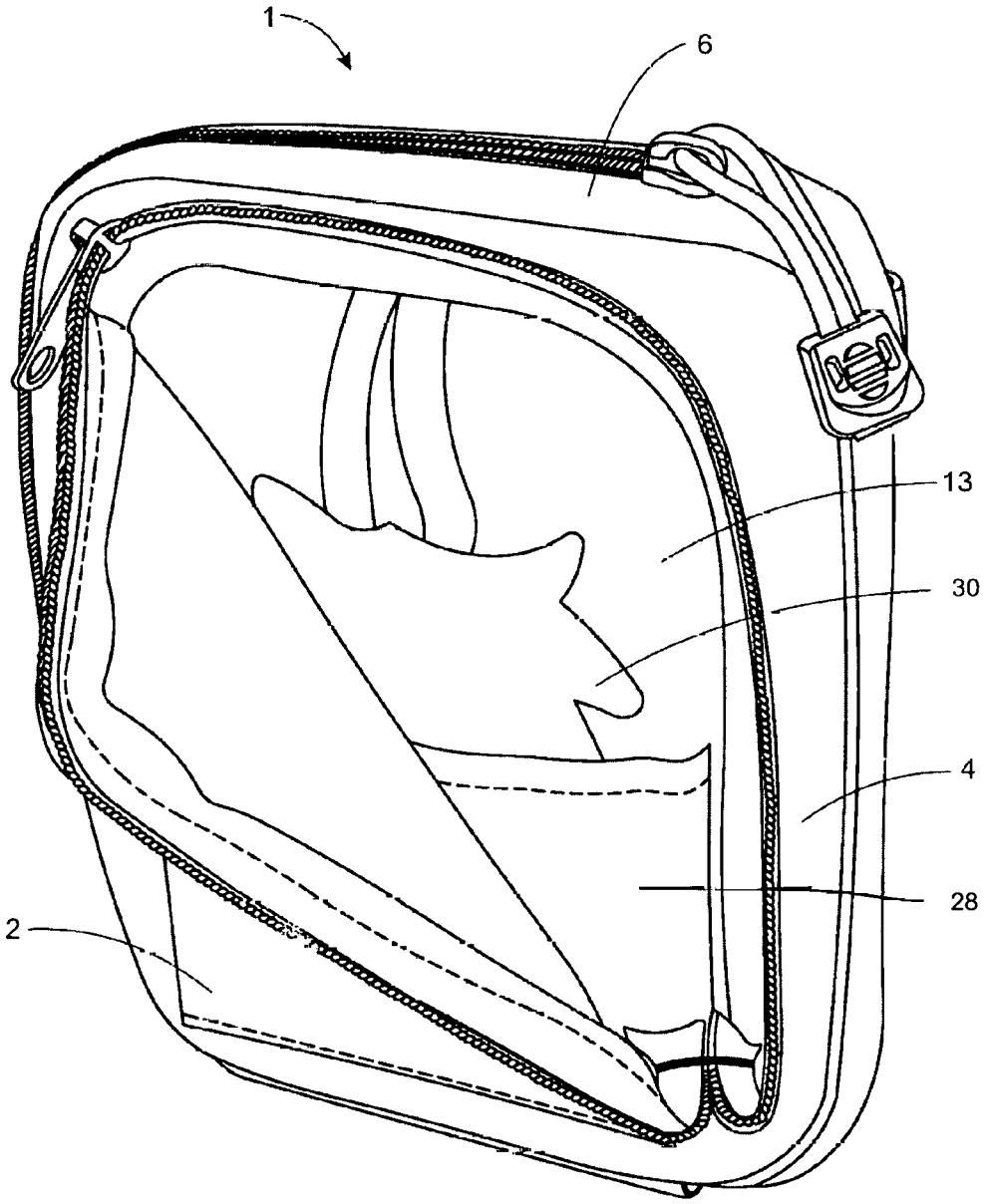
FIG. 6 shows a separate outside pouch that partially forms the front face of the bag. The outside pouch is open, revealing a law enforcement badge.

FIG. 6 shows particulars of outer compartment (13) as seen from the front face (2) of bag (1). Law enforcement badge (30) is shown within outer compartment (13). As seen in FIG. 6, zipper (15) extends along and parallel to front side panel (4), and across and parallel to top side panel (6), or 180 degrees along the bag perimeter.

Figure 7:
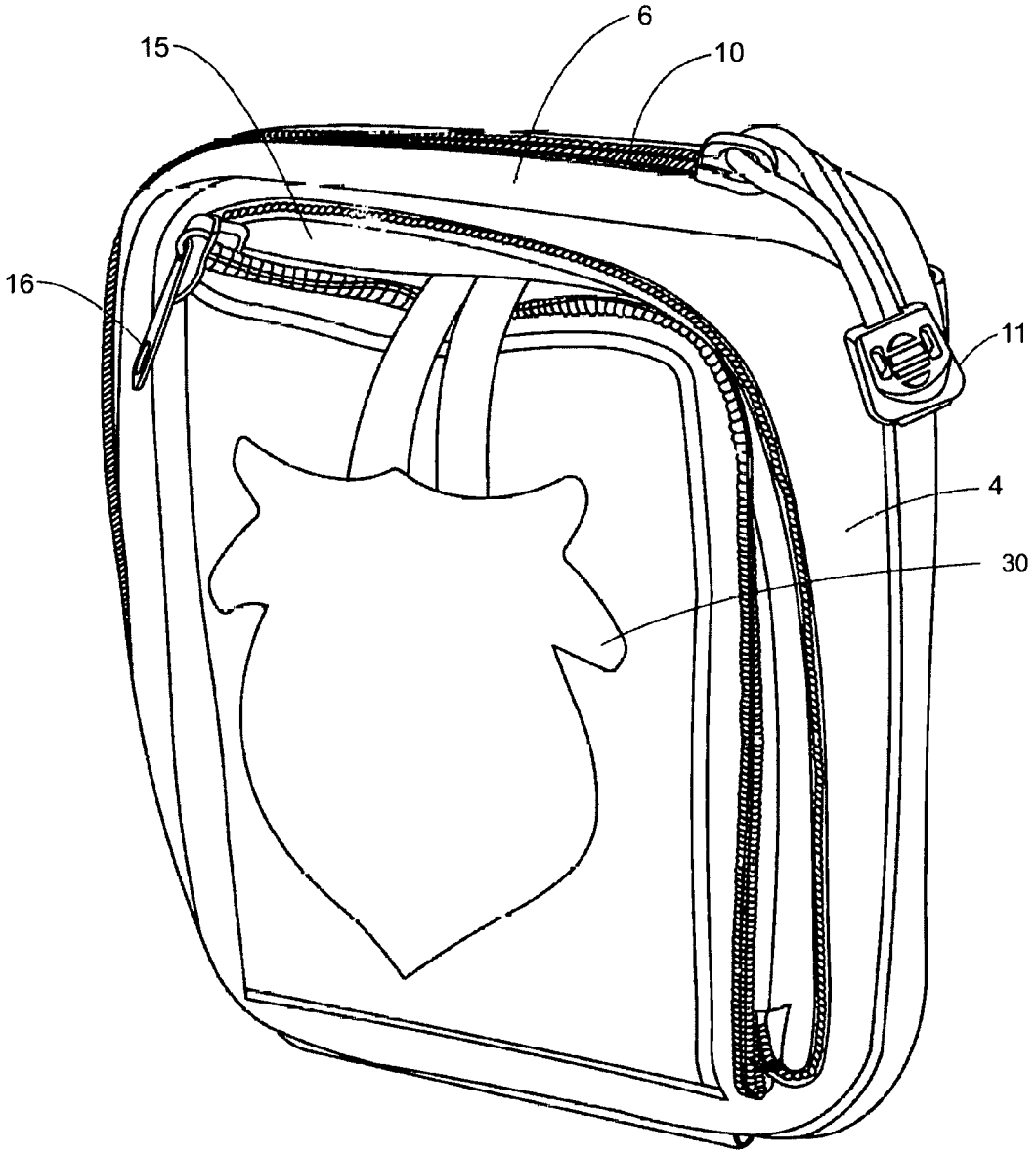
FIG. 7 shows the front face of the bag in perspective view with the side face of the bag which would face front of the user's torso, for a right-handed user. A law enforcement badge hangs outside the bag, attached to a badge loop secured inside the outer pouch.

FIG. 7 shows law enforcement badge (30) exposed when zipper (15) is fully disengaged.

Figure 8:
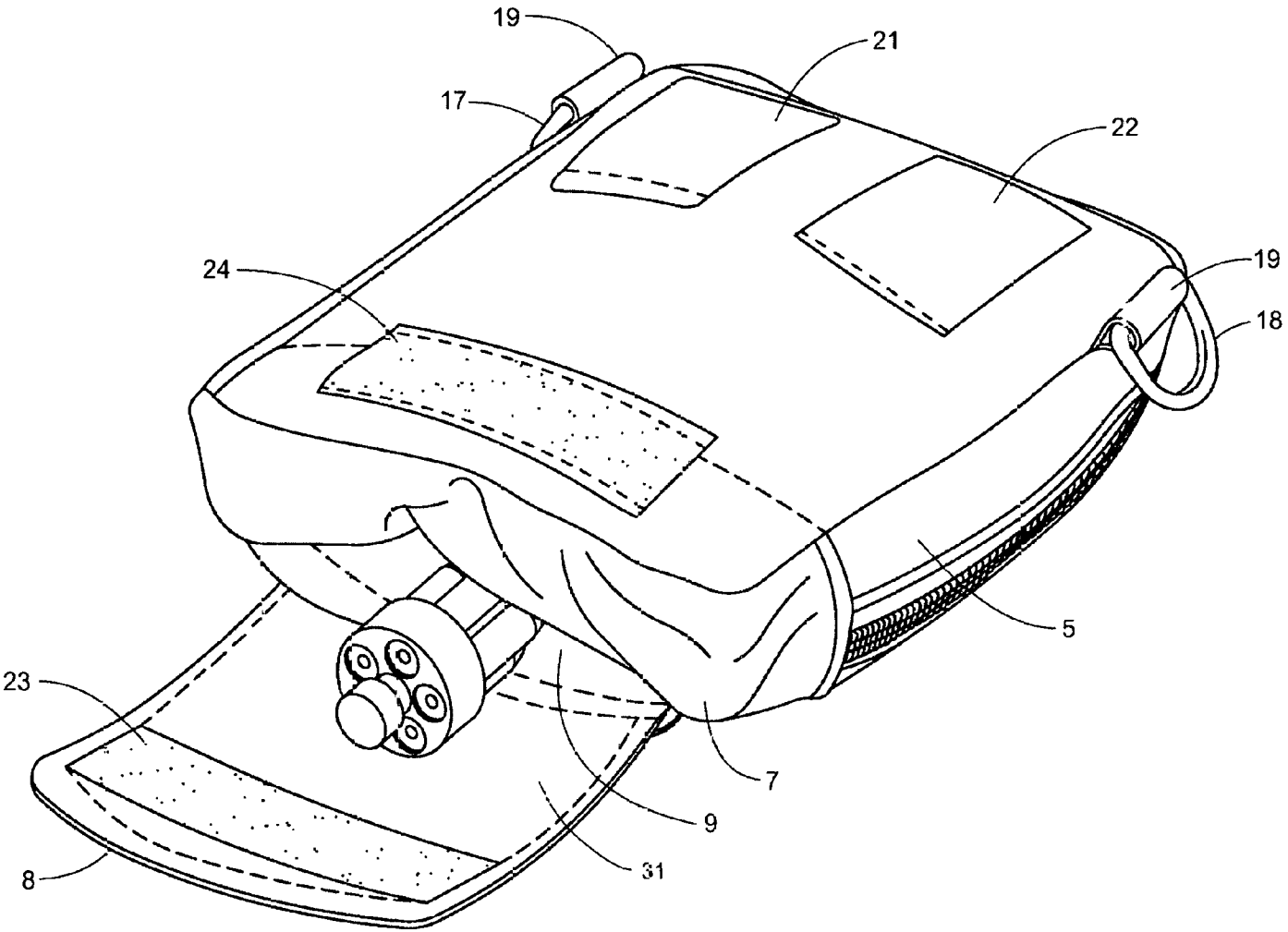
FIG. 8 shows the rear face of the bag with the ammunition compartment in an open position and a speed-loader for a revolver extending from the ammunition compartment.

FIG. 8 shows bag (1) as viewed from the rear face, with flap (8) fully disengaged, exposing ammunition compartment (9). Speed loader (31), specifically designed to rapidly reload a revolver, is seen dropping from the bottom of bag (1), to be conveniently handled by a user The interior of firearm compartment (12) is conveniently provided with separator panel (28), that is stitched to the inside of rear lace (3). The barrel of a firearm is stored between separator panel (28) and the inside of rear face (3). The outside of ammunition compartment (9) is located completely within and is completely separated from the interior of firearm compartment (12). Because the ammunition compartment (9) is made small enough to just accommodate a magazine or rapid loading apparatus for a revolver, ammunition compartment (9) takes up little volume within firearm compartment (12). In design, the top of ammunition compartment (9) lies well below where the grip portion of a firearm would be located. Therefore, the ammunition compartment will not interfere with the user's hand when a firearm is accessed. Also, because the outside of ammunition compartment (9) is located between separator panel (28) and the inner face (2) of the bag, items in ammunition compartment (9) will not interfere with the user's hand when the user reaches for the grip of a handgun located in firearm compartment (12).

Figure 9:
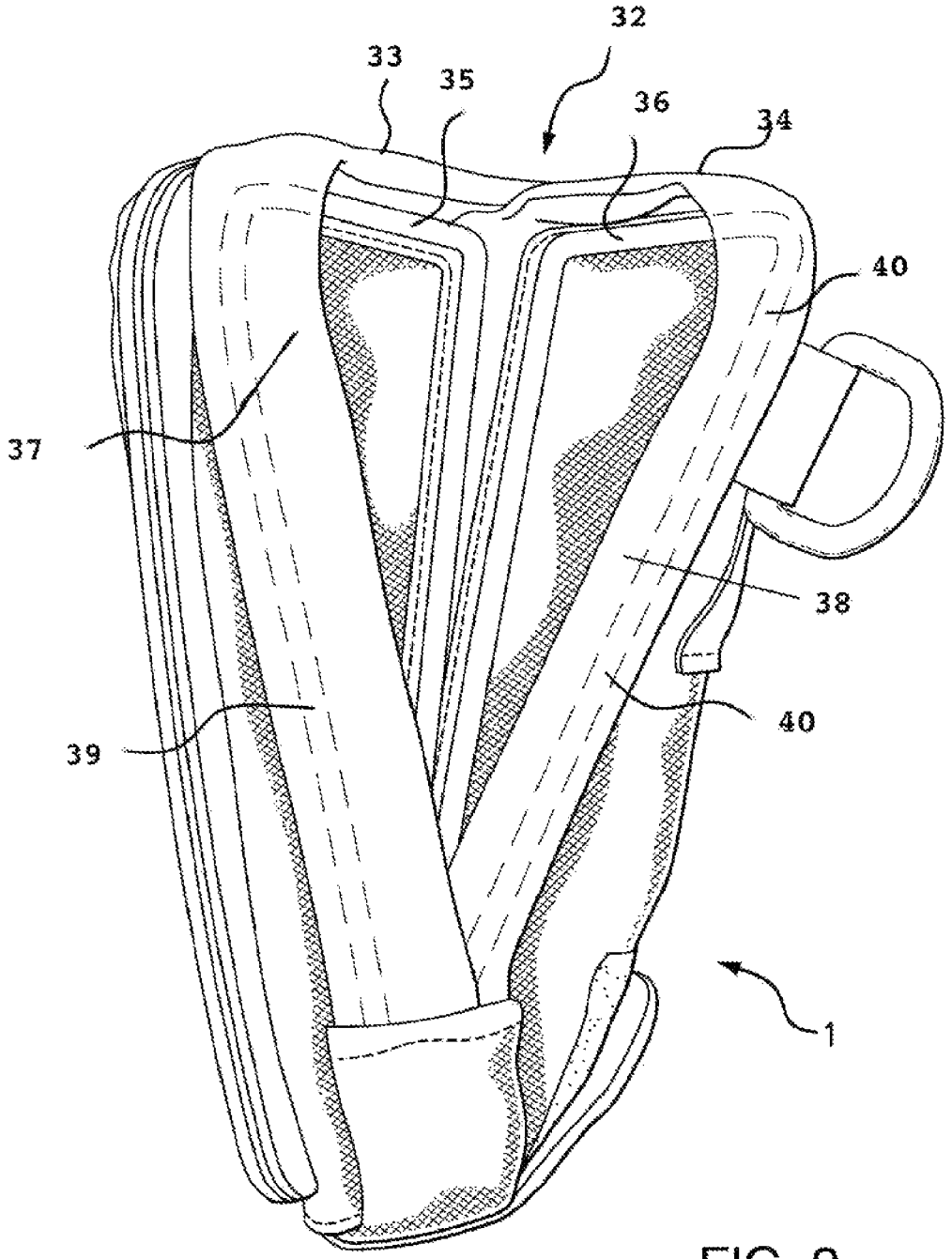
FIG. 9 shows an alternate embodiment of the invention where the firearm compartment is releasably closed with a magnetic closure.

FIG. 9 shows an alternate embodiment of the handgun pouch. In this embodiment, the zipper (10) is replaced with magnetic closure (32). Utilization of a magnetic closure eliminates the possibility of a stuck zipper in an emergency situation. The bag is constructed of front and rear face panels with a first horizontal side panel and a first vertical side panel permanently interposed between the front and rear panels. Horizontal side flap (33) overlies second horizontal side panel (34); horizontal side flap (33) and horizontal side panel (34) are secured together with horizontal magnetic material (35) and (36), which are embedded within the side flap (33) and side panel (34), such that the magnetic materials (35) and (36) overlie when the handgun compartment is in closed position. Of course either of the magnetic materials (35) or (36) may be a ferromagnetic material such as steel or iron, so long as one permanent magnet is located within either horizontal side flap (33) or horizontal side panel (34). Both (35) and (36) could be permanent magnets, because two magnets with opposite polarity increases the magnetic force over the combination of a single magnet and a ferromagnetic material. Second vertical flap (37) overlies second vertical panel (38); second vertical flap (37) and second vertical panel (38) are secured together with vertical magnetic materials (39) and (40), which are embedded within the second vertical flap (37) and the second vertical panel (38). Again, either (39) or (40) may be a ferromagnetic material such as steel or iron, so long as one permanent magnet is located within either the second vertical flap (37) or second vertical panel (38). The use of two permanent magnetics is preferred because this increases the strength of the magnetic closure. It is also contemplated that the horizontal magnetic material (35) and vertical magnetic material (39) could comprise a single one-piece strip that extends across the horizontal top and the vertical side of the bag. Similarly, magnetic materials (36) and (40) could be constructed from a single, one-piece strip. Alternatively, several discontinuous magnetic materials could be embedded into the horizontal and vertical sides of the bag in order to form the magnetic closure.

It is expressly understood that the second horizontal side panel and the second vertical side panel need only extend to the top and rear side periphery of the front face panel. In fact, the second horizontal side panel and the second vertical side panel could be completely eliminated. The important criteria is that the magnetic closure embedded within the horizontal side flap and the vertical side flap juxtapose the magnetic closure located around the top and rear edge of the front face panel.

The panels that form firearm bag (1) are most conveniently manufactured from a flexible woven fabric, although the invention is not limited to any particular material from which to manufacture the bag. In a preferred embodiment the outside surface of the panels comprises a fabric integrally bonded to a foamed material, the foamed material interposed between the outside surface fabric and a non-tear synthetic fabric which lines the interior of the bag. A preferred material for the bag is a polyester or nylon base fabric with PVC or urethane backing, flame or otherwise laminated to the foam and then flame or otherwise laminated to a non-tear synthetic fabric interior liner. Because the inner surface of the panels are foam, they have padding properties that both protect the firearm and aid in concealing any imprint that would reveal the presence of the firearm within the bag. Zippers (10) and (15) are made of polymeric material, however any suitable material for the zippers is contemplated to be within the scope of the invention.

The invention claimed is:

1. A pouch for a handgun comprising a woven fabric bag adapted to be worn on the belt of a user, the bag including a releasably closable ammunition compartment located within and on the bottom of the bag for accessing an extra magazine for a semi-automatic handgun or rapid reloading apparatus for a revolver, wherein the compartment is closed with a flap secured to the bag and releasable from the bag by micro hook and loop fasteners, and wherein the compartment is oriented such that upon separating the flap from the bag the contents of the compartment drop into the hand of the user by gravity, wherein the pouch is constructed with one front face panel and a parallel rear face panel, with at least one vertical side panel permanently affixed to the front and rear panels, and at least one horizontal side panel permanently affixed to the front and rear panels, the vertical and horizontal side panels interposed between the front face panel and the rear face panel forming two perimeter sides of the bag interposed between the front and rear face panels, further comprising a first horizontal side flap and a first vertical side flap, wherein the side flaps are located parallel to the side panels affixed to the front and rear panels, and on opposite sides of the bag from the side panels, wherein the horizontal side flap overlie a magnetic closure releasably scaling the horizontal side flap, and wherein the vertical side flap overlies a magnetic closure releasably sealing the vertical side flap, such that the horizontal side flap and the vertical side flap can be releasably closed and opened around the top and rear of the pouch, such that the user can open the pouch and reach into the pouch to access a handgun.

2. The pouch of claim 1 wherein the magnetic closure comprises at least one magnet embedded within the horizontal side flap and at least one magnet embedded within the vertical side flap and a ferromagnetic material embedded around the perimeter of the front face panel and juxtaposed to the magnets embedded within the side flaps.

3. The pouch of claim 1 wherein the magnetic closure comprises at least one ferromagnetic material embedded within the horizontal side panel and at least one ferromagnetic embedded within the vertical side panel and at least one magnet embedded around the perimeter of the front face panel and juxtaposed to the magnets embedded within the side flaps.

4. The pouch of claim 1 wherein the magnetic closure comprises at least one magnet embedded within the horizontal side flap and at least one magnet embedded within the vertical side flap and at least one magnet embedded around the perimeter of the front face panel and juxtaposed to the magnets embedded within the side flaps.

5. The pouch of claim 1 further including an outer compartment overlying the front face panel, constructed with a zipper releasably separating the outer compartment from the face panel.

6. The pouch of claim 1 further including a separator panel within the interior firearm compartment, the separator panel attached to the inside surface of the rear face panel and adapted to store a firearm between the separator panel and the inside surface of the rear face panel.

7. The pouch of claim 1 wherein the ammunition compartment located within the bag completely separates the firearm compartment from the ammunition.

8. The pouch of claim 1 wherein the panels comprise flexible woven fabric.

9. The pouch of claim 1 including D rings attached to the top of the rear panel adapted to attach to a user's belt.

10. The pouch of claim 1 wherein the outside surface of the panels comprises a fabric integrally bonded to a foamed material, the foamed material interposed between the outside surface fabric and a non-tear synthetic fabric which lines the interior of the bag.

11. The pouch of claim 1 wherein the magnetic closure is embedded within a second horizontal side panel that underlies the first horizontal side flap, and the magnetic closure is embedded in a second vertical side panel that underlies the first vertical side flap.

12. The pouch of claim 11 wherein the magnetic closure comprises at least one magnet embedded within the horizontal side flap and at least one ferromagnetic material embedded within the second horizontal side panel and at least one magnet embedded within the vertical side flap and at least one ferromagnetic material embedded within second vertical side panel, the horizontal side flap and the vertical side flap juxtaposed over the second horizontal side panel and the second vertical side panel such that the magnets and ferromagnetic materials form a releasable magnetic seal.

13. The pouch of claim 11 wherein the magnetic closure comprises at least one ferromagnetic material embedded within the horizontal side flap and at least one magnet embedded within the second horizontal side panel and at least one ferromagnetic material embedded within the vertical side flap and at least one magnet embedded within second vertical side panel, the horizontal side flap and the vertical side flap juxtaposed over the second horizontal side panel and the second vertical side panel such that the magnets and ferromagnetic materials form a releasable magnetic seal.

14. The pouch of claim 11 wherein the magnetic closure comprises at least one magnet embedded within the horizontal side flap and at least one magnet embedded within the second horizontal side panel and at least one magnet embedded within the vertical side flap and at least one magnet embedded within second vertical side panel, the horizontal side flap and the vertical side flap juxtaposed over the second horizontal side panel and the second vertical side panel such that the magnets form a releasable magnetic seal.

* * * * *